US010557293B2

(12) United States Patent
Kalathil et al.

(10) Patent No.: US 10,557,293 B2
(45) **Date of Patent: *Feb. 11, 2020**

(54) CLOSURE LATCH ASSEMBLIES

(71) Applicant: AMI Industries, Inc., Colorado Springs, CO (US)

(72) Inventors: Sajeesh Kalathil, Karnataka (IN); Lokesh Narayanamurthy, Karnataka (IN); Brad Kaiser, Peyton, CO (US)

(73) Assignee: AMI INDUSTRIES, INC., Colorado Springs, CO (US)

( * ) Notice: Subject to any disclaimer, the term of this patent is extended or adjusted under 35 U.S.C. 154(b) by 330 days.

This patent is subject to a terminal disclaimer.

(21) Appl. No.: 15/426,103

(22) Filed: Feb. 7, 2017

(65) Prior Publication Data

US 2018/0171687 A1 Jun. 21, 2018

(30) Foreign Application Priority Data

Dec. 15, 2016 (IN) ..... 201611042838

(51) Int. Cl.
*E05C 9/00* (2006.01)
*E05C 1/12* (2006.01)
(Continued)

(52) U.S. Cl.
CPC ..... *E05C 1/12* (2013.01); *E05B 5/00* (2013.01); *E05B 9/00* (2013.01); *E05B 15/0205* (2013.01)

(58) Field of Classification Search
CPC ..... Y10T 292/0834; Y10T 292/0836; Y10T 292/0841; Y10T 292/0846;
(Continued)

(56) References Cited

U.S. PATENT DOCUMENTS 3,026,131 A * 3/1962 Krause ..... E05B 83/247 292/11
3,743,336 A 7/1973 Andrews
(Continued)

FOREIGN PATENT DOCUMENTS

GB 2283277 A 5/1995

OTHER PUBLICATIONS

European Search Report, European Application No. 17206762.1, dated Apr. 17, 2018, European Patent Office; European Search Report 7 pages.

*Primary Examiner* — Jerry E Redman
(74) *Attorney, Agent, or Firm* — Cantor Colburn LLP

(57) ABSTRACT

Latch assemblies for opening and closing openable structures having a housing defining a cavity, a handle movably mounted to the housing, and a latching mechanism between the handle and the housing. The latching mechanism includes at least one guide pin mounted to the housing, a first body movable along the at least one guide pin and having a first latching element extending through the housing, a second body movable along the at least one guide pin and having a second latching element extending through the housing, a first link attached to the first body, a second link attached to the second body, and a link connector operably connecting the first link to the second link, wherein movement of the link connector urges the first latching element and the second latching element apart through movement of the first link and the second link and the first body and the second body.

20 Claims, 12 Drawing Sheets

(51) Int. Cl.
*E05B 5/00* (2006.01)
*E05B 9/00* (2006.01)
*E05B 15/02* (2006.01)

(58) Field of Classification Search
CPC ..... Y10T 292/0844; E05C 9/02; E05C 9/03; E05C 9/04; E05C 9/05; E05C 9/06; E05C 1/12; E05B 5/006; E05B 63/143; E05B 63/14
See application file for complete search history.

(56) References Cited

U.S. PATENT DOCUMENTS 3,857,594 A 12/1974 Pastva
6,079,585 A * 6/2000 Lentini ..... B60R 9/00 220/210
6,145,352 A 11/2000 Vickers et al.
6,349,577 B1 * 2/2002 Hansen ..... E05B 5/00 292/DIG. 31
6,454,320 B1 * 9/2002 Weinerman ..... E05B 13/105 290/53
6,502,868 B1 * 1/2003 Laspa ..... B25H 3/02 292/11
6,857,298 B2 * 2/2005 Linares ..... E05B 63/143 292/DIG. 37
7,497,103 B1 3/2009 Misner
7,681,767 B2 * 3/2010 Cheney ..... B60R 9/00 224/404
9,151,078 B2 * 10/2015 Lackey ..... E05B 63/143
9,260,890 B2 * 2/2016 Harrison ..... E05B 65/5284
2018/0038139 A1 * 2/2018 Zindler ..... E05B 81/20
2018/0171687 A1 * 6/2018 Kalathil ..... E05B 5/00
2018/0171689 A1 * 6/2018 Kalathil ..... E05B 15/0205

* cited by examiner

CLOSURE LATCH ASSEMBLIES

CROSS REFERENCE TO RELATED APPLICATIONS

This application claims priority to Indian Patent Application No. 201611042838 filed Dec. 15, 2016, the entire contents of which is incorporated herein by reference.

BACKGROUND

The subject matter disclosed herein generally relates to latch assemblies and, more particularly, to latch assemblies for opening and closing openable structures.

Existing latches for closures are configured to close with minimal effort. That is, minimal effort is needed to be expended by a user to operate a locking/latching mechanism to open an openable structure (e.g., a closure, door, panel, etc.). Accordingly, a user can operate the latch assembly to open or close (and secure) the openable structure with ease when a latch lever is operated (e.g., pulled, rotated, lifted, etc.). Traditionally a plunger assembly is provided to be operated by a handle. The plunger assembly can move relative to a securing feature (e.g., a latch catch or locking bracket) to secure the latch assembly and thus secure the openable structure in a closed position. However, such latch assemblies may be subject to reliability issues over time and may fail to open or close as intended during usage. This degraded performance can result from continued use over the life of the latch assembly. As such, frequent replacement of the latch assembly and/or portions thereof may be required.

Further, multiple latches, such as a dual latch may be employed with openable structures to provide additional functionality and/or securing. For example, a dual latch can provide securing at multiple locations on an openable structure. Further, based on some configurations, operation of one of the two latches can be operated and the other of the two latches will operate in tandem. That is, a dual latch can provide functionality of both latches by operation of only one of the latches. Thus, for example, when either of a left hand latch or a right hand latch is operated the other of the latches will synchronously operate. However, in existing dual latch systems, the dual latch may not always close or open after continuous usage for a period of time (e.g., fatigue).

SUMMARY

According to some embodiments, latch assemblies for opening and closing openable structures are provided. The latch assemblies include a housing defining a cavity, a handle movably mounted to the housing, and a latching mechanism in the cavity and disposed between the handle and the housing. The latching mechanism includes at least one guide pin mounted to the housing, a first body movable along the at least one guide pin, the first body having a first latching element extending through the housing, a second body movable along the at least one guide pin, the second body having a second latching element extending through the housing, a first link attached to the first body, a second link attached to the second body, and a link connector operably connecting the first link to the second link, wherein movement of the link connector urges the first latching element and the second latching element apart through movement of the first link and the second link and the first body and the second body.

In addition to one or more of the features described herein, or as an alternative, further embodiments of the latch assembly may include an actuation arm fixedly connected to the handle such that movement of the handle causes movement of the link connector.

In addition to one or more of the features described herein, or as an alternative, further embodiments of the latch assembly may include a cover installed between the handle and the latching mechanism within the cavity, the cover configured to cover the first body and the second body.

In addition to one or more of the features described herein, or as an alternative, further embodiments of the latch assembly may include that the cover includes at least one cover guiding structure, the cover guiding structure configured to guide movement of the link connector.

In addition to one or more of the features described herein, or as an alternative, further embodiments of the latch assembly may include that the cover includes an actuation slot where the actuation arm passes through the cover to interact with the link connector.

In addition to one or more of the features described herein, or as an alternative, further embodiments of the latch assembly may include that the housing includes at least one housing guiding structure, the housing guiding structure configured to guide movement of the link connector.

In addition to one or more of the features described herein, or as an alternative, further embodiments of the latch assembly may include at least one biasing member disposed on the at least one guide pin and configured to urge the first body toward the second body along the at least one guide pin.

In addition to one or more of the features described herein, or as an alternative, further embodiments of the latch assembly may include that the at least one biasing member comprises a first biasing member disposed between the first body and the housing and a second biasing member disposed between the second body and the housing.

In addition to one or more of the features described herein, or as an alternative, further embodiments of the latch assembly may include a locking bracket configured to receive the first latching member and the second latching member to secure the latching members in a first state.

In addition to one or more of the features described herein, or as an alternative, further embodiments of the latch assembly may include that the locking bracket includes a catch arm, the catch arm having at least one stop surface configured to receive the first latching element and the second latching element to secure the first and second latching elements in the first state.

In addition to one or more of the features described herein, or as an alternative, further embodiments of the latch assembly may include that the catch arm further includes a spreading surface configured to spread the first latching member apart from the second latching member when the latch assembly is moved into the first state.

In addition to one or more of the features described herein, or as an alternative, further embodiments of the latch assembly may include that each of the first latching element and the second latching element comprise a complementary engagement surface that engages with and runs along the spreading surface of the catch arm.

In addition to one or more of the features described herein, or as an alternative, further embodiments of the latch assembly may include that a portion of the catch arm has a width and the first and second latching elements are separated by a first separation distance that is less than the width of the catch and the first and second latching elements are separated by a second separation distance that is greater than the width of the catch such that the first and second latching elements can move freely relative to the catch arm.

According to other embodiments, latch assemblies for opening and closing openable structures are provided. The latch assemblies include a housing defining a cavity, a handle movably mounted to the housing, and a latching mechanism in the cavity and disposed between the handle and the housing. The latching mechanism includes at least one guide pin mounted to the housing, a first body movable along the at least one guide pin, the first body having a first latching element extending through the housing and having an inclined surface, a second body movable along the at least one guide pin, the second body having a second latching element extending through the housing and having an inclined surface, a movable wedge positioned between the inclined surfaces of the first body and the second body, and an actuation arm fixedly connected to the handle such that movement of the handle causes movement of the movable wedge, wherein movement of the movable wedge urges the first latching element and the second latching element apart through movement of the first body and the second body spread by the movable wedge along the inclined surfaces.

According to other embodiments, openable structures are provided. The openable structures include a frame, a closure body movable relative to the frame, and a first latch assembly at least partially installed to the closure body. The first latch assembly includes a housing defining a cavity, the housing fixedly attached to the closure body, a handle movably mounted to the housing, and a latching mechanism in the cavity and disposed between the handle and the housing. The latching mechanism includes at least one guide pin mounted to the housing, a first body movable along the at least one guide pin, the first body having a first latching element extending through the housing, a second body movable along the at least one guide pin, the second body having a second latching element extending through the housing, a first link attached to the first body, a second link attached to the second body, and a link connector operably connecting the first link to the second link, wherein movement of the link connector urges the first latching element and the second latching element apart through movement of the first link and the second link and the first body and the second body.

In addition to one or more of the features described herein, or as an alternative, further embodiments of the openable structure may include a locking bracket mounted to the frame and configured to receive the first latching member and the second latching member to secure the latching members in a first state such that the closure body is secured within the frame.

In addition to one or more of the features described herein, or as an alternative, further embodiments of the openable structure may include that the locking bracket includes a catch arm, the catch arm having at least one stop surface configured to receive the first latching element and the second latching element to secure the first and second latching elements in the first state.

In addition to one or more of the features described herein, or as an alternative, further embodiments of the openable structure may include that the catch arm further includes a spreading surface configured to spread the first latching member apart from the second latching member when the latch assembly is moved into the first state.

In addition to one or more of the features described herein, or as an alternative, further embodiments of the openable structure may include that a portion of the catch arm has a width and the first and second latching elements are separated by a first separation distance that is less than the width of the catch and the first and second latching elements are separated by a second separation distance that is greater than the width of the catch such that the first and second latching elements can move freely relative to the catch arm.

In addition to one or more of the features described herein, or as an alternative, further embodiments of the openable structure may include a second latch assembly, wherein the first and second latch assemblies are operably connected to operate synchronously upon operating of one of the first or second latch assemblies.

Technical effects of embodiments of the present disclosure include latch assemblies having multiple bodies operably connected, each body having a latching element to ensure proper latching and provide increased latch life. Further technical effects include assembly connectors to operably connect multiple latch assemblies to enable synchronous operation of the multiple latch assemblies.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
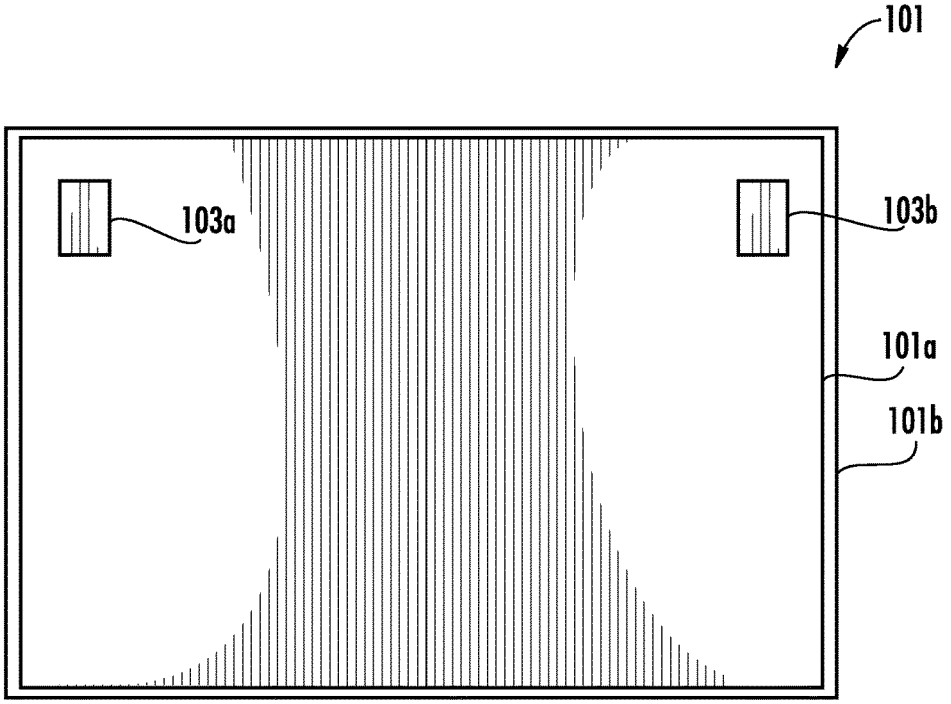
FIG. 1A PRIOR ART
FIG. 1A is a schematic illustration of an openable structure having two latching mechanisms in accordance with the prior art.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "##" that is shown in FIG. X may be labeled "X##" and a similar feature in FIG. Z may be labeled "Z##." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Figure 1B:
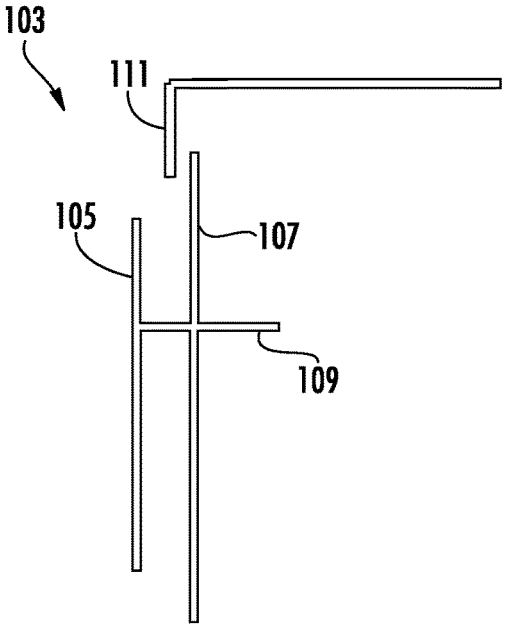
FIG. 1B PRIOR ART
FIG. 1B is a schematic illustration of operation of one of the latching mechanisms of FIG. 1A in a closed position.
Figure 1C:
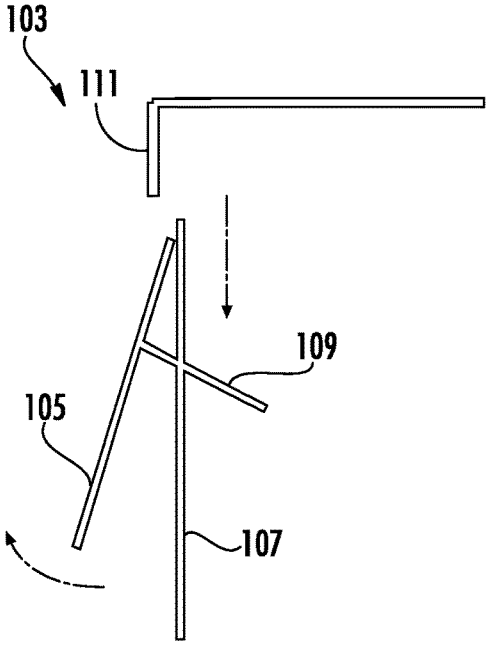
FIG. 1C PRIOR ART
FIG. 1C is a schematic illustration of operation of one of the latching mechanisms of FIG. 1A in an open position.

FIGS. 1A-1C are schematic illustrations of an openable structure and latching assembly in a traditional configuration. FIG. 1A is a schematic illustration of an openable structure 101 having two latching mechanisms 103 (labeled 103*a*, 103*b* in FIG. 1A). The openable structure 101 is a door, hatch, panel, or other openable and closable structure having a closure body 101*a* that can be operated and movable, in part, by operation of one or both of the latching mechanisms 103. The closure body 101*a* fixedly attaches to a frame 101*b* when in a closed and secured stated. The closure body 101*a* is movable (e.g., slidable, rotatable, pivotable, etc.) with respect to the frame 101*b*. The latching mechanisms 103 can be manually operated by a person that desires to open or close the openable structure 101. In a first position the latching mechanisms 103 can be engaged and securely retain the closure body 101*a* in a closed position and in a second position the latching mechanisms 103 can be disengaged and enable the openable structure 101 to be opened (or closed). That is, in the second position of the latching mechanisms 103, the closure body 101*a* can be moved between a closed position and an open position.

FIG. 1B schematically illustrates one of the latching mechanisms 103 in the first position and FIG. 1C schematically illustrates the latching mechanism 103 in the second position. As shown, the latching mechanism 103 includes a handle 105 that is operably and/or movably connected to a plunger 107 by a lever arm 109. The plunger 107 is configured to engage with or contact a catch 111. The catch 111 may be an integral part or portion of the closure body 101*a* and/or the openable structure 101 or may be a separate element that is fixedly connected to or otherwise attached to the closure body 101*a* and/or the openable structure 101. The plunger 107 can be a bar, rod, plate, or other physical structure that, when in the first position (FIG. 1B), contacts or engages with the catch 111 to secure the latching mechanism 103 and thus the openable structure 101 in a closed state.

However, when a user manually operates the handle 105, the handle can rotate (as shown as curved dashed arrow in FIG. 1C) and operate the lever arm 109 in a downward manner (as shown as dashed arrow in FIG. 1C). As the lever arm 109 moves downward it pulls the plunger 107 downward such that the plunger 107 clears the catch 111 and the latching mechanism 103 can be pulled outward to open the openable structure 101. The reverse operation can be used to close the openable structure 101 and allow the plunger 107 to secure behind the catch 111 and lock or secure the openable structure 101 in the closed position.

Such latching mechanisms as shown and described in FIGS. 1A-1C can be used in various settings, and in one non-limiting example, can be used for aircraft closures within a cabin. For example, the latching mechanisms can be used to secure foldable seats, doors of cabinets and cubbies for storage, or other openable structures within an aircraft cabin. Because the openable structures may be located on an aircraft, ensuring proper closure and securing is an important consideration. However, use of latching mechanisms as shown in FIGS. 1A-1C, over time, can degrade, and thus the latching aspect may not be as secure as desired, needed, or required.

Figure 2C:
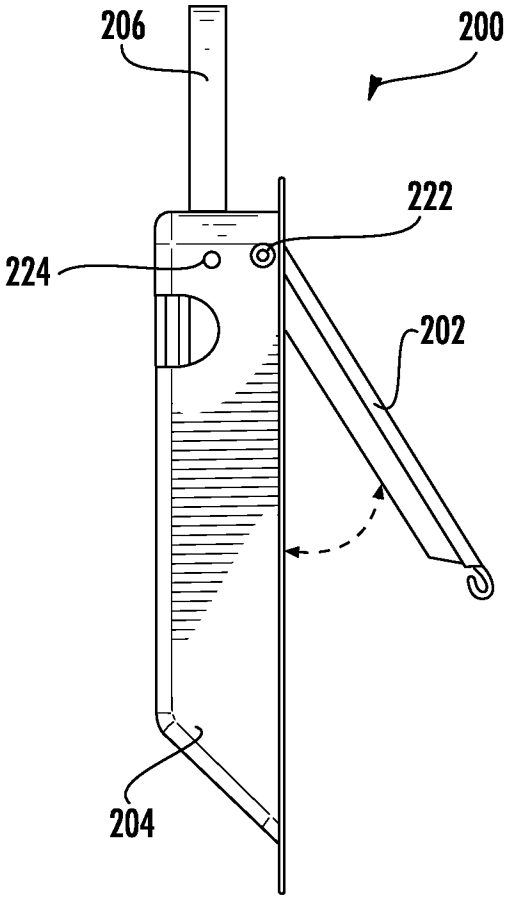
FIG. 2C is a side elevation illustration of the latch assembly of FIG. 2A.
Figure 2B:
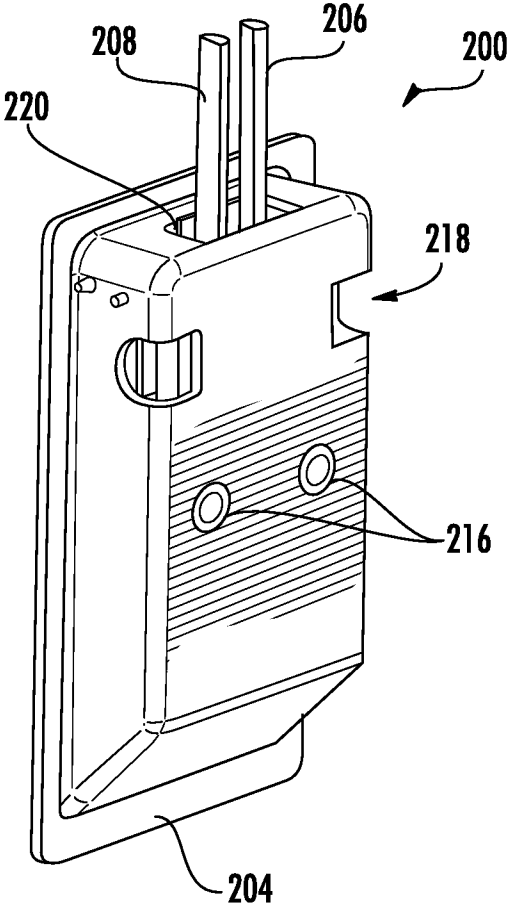
FIG. 2B is a rear perspective illustration of the latch assembly of FIG. 2A.
Figure 2A:
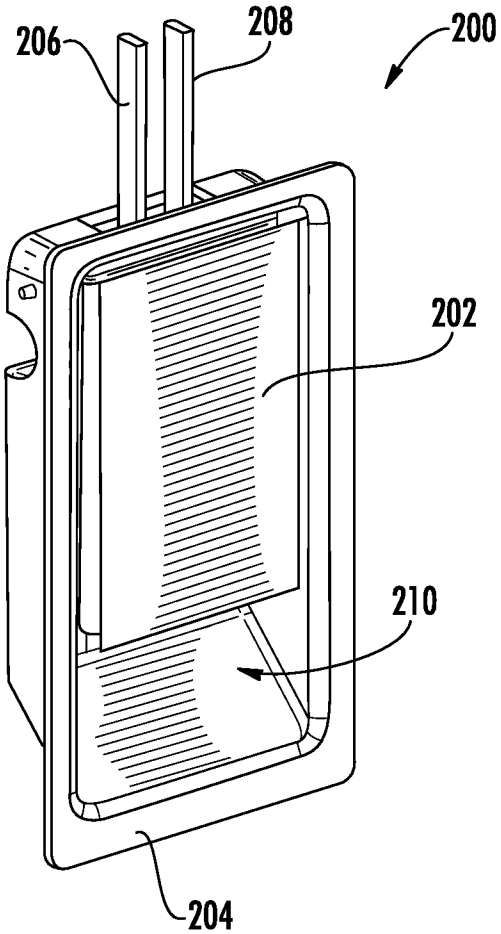
FIG. 2A is a front perspective illustration of a latch assembly in accordance with an embodiment of the present disclosure.

Turning now to FIGS. 2A-2I, schematic illustrations of a latch assembly 200 in accordance with an embodiment of the present disclosure are shown. FIGS. 2A-2I illustrate various components of the latch assembly 200 and the operation thereof. FIG. 2A is a front perspective illustration of the latch assembly 200 as assembled. As shown in FIG. 2A, the latch assembly 200 includes a handle 202, a housing 204, a first latching element 206, and a second latching element 208. The handle 202 fits within a cavity 210 defined within the housing 204.

Figure 2F:
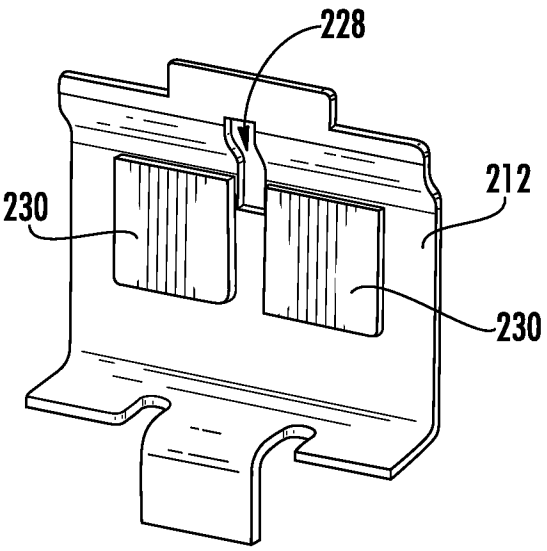
FIG. 2F is a perspective illustration of a cover of the latch assembly of FIG. 2A.
Figure 2E:
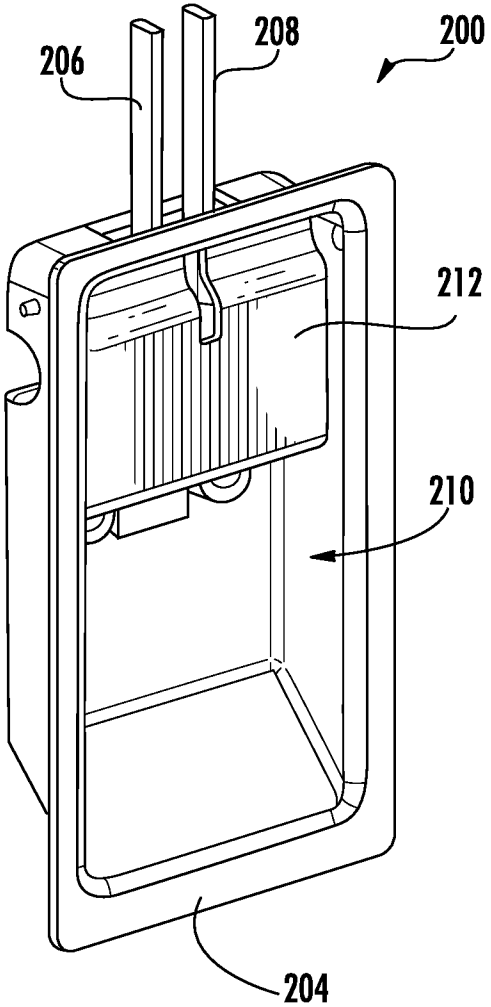
FIG. 2E is a perspective illustration of the latch assembly of FIG. 2A with the handle removed.
Figure 2D:
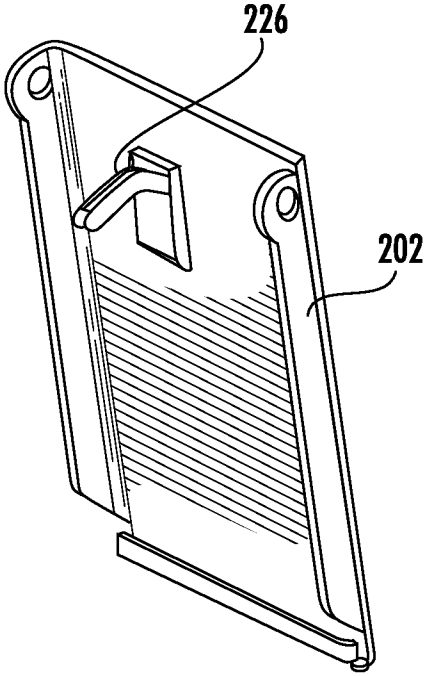
FIG. 2D is a schematic illustration of a handle of the latch assembly of FIG. 2A.
Figure 2I:
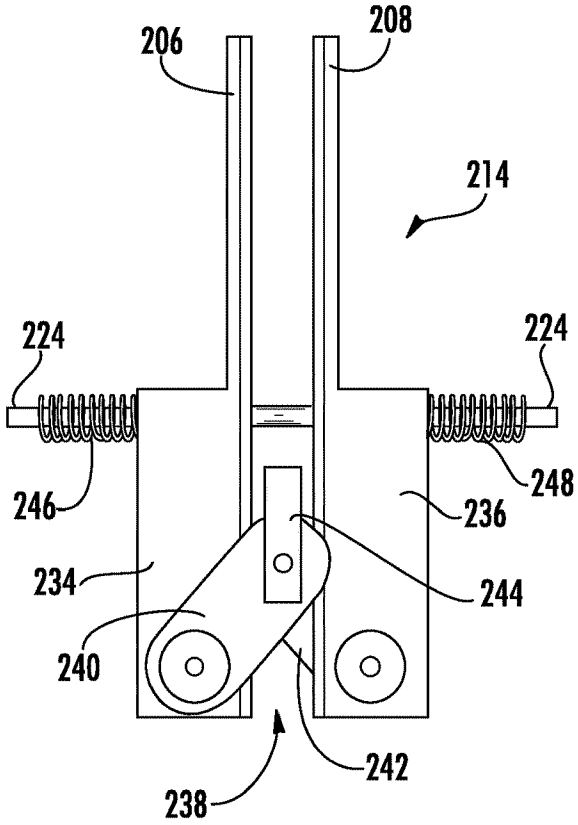
FIG. 2I is a front elevation illustration of the latching mechanism shown in FIG. 2H.
Figure 2H:
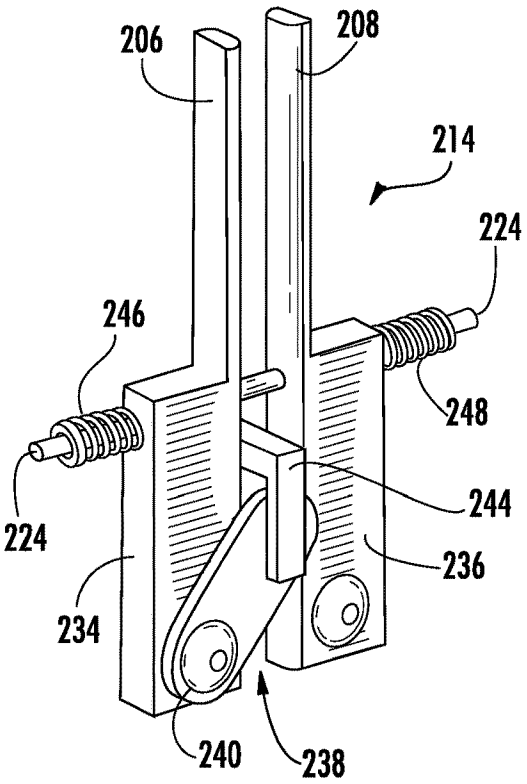
FIG. 2H is a perspective illustration of a latching mechanism of the latch assembly of FIG. 2A.
Figure 2G:
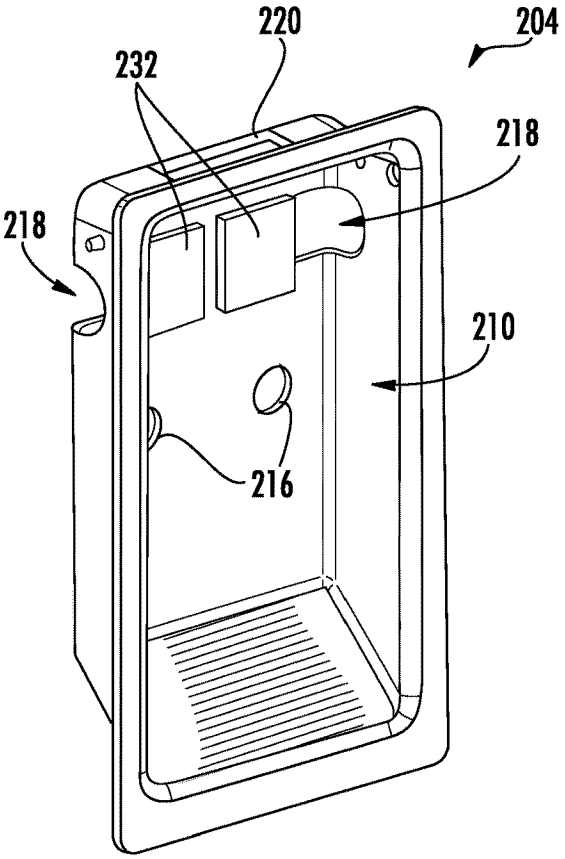
FIG. 2G is a perspective illustration of a housing of the latch assembly of FIG. 2A with no components installed therein.

FIG. 2B is a rear perspective illustration of the latch assembly 200 as assembled. FIG. 2C is a side view illustration indicating operation of a handle 202 of the latch assembly 200. FIG. 2D is a rear view isometric illustration of the handle 202. FIG. 2E is a schematic illustration of the latch assembly 200 with the handle 202 removed and illustrating a cover 212. FIG. 2F is an illustration of the cover 212 separated from the latch assembly 200. FIG. 2G is a schematic illustration of the housing 204 with interior elements removed therefrom. FIGS. 2H-2I are schematic illustrations of a latching mechanism 214 shown outside of the housing 204, the latching mechanism 214 including the first latching element 206 and the second latching element 208.

As noted, the latch assembly 200 includes the handle 202, the housing 204, and the latching mechanism 214 installed therein. The housing 204 can be configured to install within or to a portion of an openable structure (e.g., openable structure 101 shown in FIG. 1A). In some embodiments, the housing 204 can be configured to fit flush or smooth with a surface of the openable structure or closure body in which the housing 204 is installed. The housing 204 can be formed of any material, and in some embodiments may be, but is not limited to, metallic, plastics, and/or composite materials. The housing 204 defines the cavity 210 into which the latching mechanism 214 is installed. The cavity 210 is configured to receive the latching mechanism 214 and the handle 202.

As shown, the first and second latching elements 206, 208 extend through a portion of the housing 204, such as the top, although the first and second latching elements 206, 208 can extend through any side of the housing without departing from the scope of the present disclosure. The first and second latching elements 206, 208 extend from the housing 204 to enable engagement with a catch or locking bracket (e.g., as shown in FIGS. 3A-3F and FIGS. 4A-4B).

Configurations of the housing 204 can include various features. For example, as shown and in some embodiments, the housing can include one or more mounting apertures 216, connection apertures 218 (as described below), and one or more latching element apertures 220. The housing 204 may further include one or more features or elements to enable receiving and retaining the latching mechanism 214 and the handle 202 therein. For example, as shown in FIG. 2C, the housing 204 can receive a handle pin 222 that enables the handle 202 to pivot thereabout, as illustrated by the arrow in FIG. 2C. Further, for example, the housing 204 can be configured to receive one or more guide pins 224 (as shown, a single guide pin 224 is employed) that is configured to guide movement of the latching elements 206, 208 within the housing 204. Although shown as a single unitary guide pin 224, in some embodiments, multiple guide pins can be provided. For example, in some embodiments, a single guide pin can be provided for each separate body (e.g., bodies 234, 236 described herein). Further, in some embodiments, multiple guide pins can be positioned at various locations on and/or in the bodies such that each body is guided by multiple guide pins. In some embodiments, a single, shorter guide pin can be configured for each body separately. In such embodiments, the guide pins can include stops, flanges, or other structure on one end to retain the bodies on the guide pins.

Referring now to FIG. 2D, a backside illustration of the handle 202 is shown. The handle 202 includes an actuation arm 226 that is fixedly connected to or integrally formed with the handle 202. The actuation arm 226 is configured to move with movement of the handle 202 such that the actuation arm 226 can actuate or otherwise operate the latching mechanism 214, as described herein. For example, as the handle 202 is rotated or moved, as shown in FIG. 2C, the actuation arm 226 moves therewith, such that a portion of the actuation arm 226 moves relative to the housing 204 (e.g., downward). In some embodiments, the movement is a tilting of the actuation arm 226 as the handle 202 is operated.

The actuation arm 226 can move within an actuation slot 228 of the cover 212. The cover 212 is fixedly mounted within the cavity 210 of the housing 204. As shown in FIG. 2E, the cover 212 can cover or otherwise protect or shield the latching mechanism 214, as will be appreciated through the illustrations of FIGS. 2A-2I. For example, at least a portion of the latching mechanism 214 is retained or otherwise contained between the housing 204 and the cover 212 within the cavity 210. Because the latching mechanism 214 is covered by the cover 212, the cover 212 includes the actuation slot 228 to enable the actuation arm 226 to interact with a portion of the latching mechanism 214.

As shown in FIG. 2F, the cover 212 can include one or more optional cover guiding structures 230. The cover guiding structures 230 are configured to guide the actuation arm 226 and/or a portion of the latching mechanism 214, as described herein.

FIG. 2G shows the housing 204 with no components installed therein. As shown, the housing 204 includes the mounting apertures 216 to enable installation of the housing 204 into an openable structure, such as by fastener (e.g., screws, nails, rivet, bolts, etc.). The mounting apertures 216 may be optional in some configurations, and may not be included depending on the mounting/installation of the housing 204 into an openable structure. Further, as shown in FIG. 2G, the housing 204 includes optional connection apertures 218 that can enable connection between two or more latch assemblies 200, as described herein. Also shown, the housing 204 can include optional housing guiding structures 232. The housing guiding structures 232 can act similarly to the cover guiding structures 230 of the cover 212, and can function in concert therewith in embodiments where both the cover guiding structures 230 and the housing guiding structures 232 are included.

Turning now to FIGS. 2H-2I, schematic illustrations of the latching mechanism 214 of the latch assembly 200 are shown. The latching mechanism 214 includes the first latching element 206 and the second latching element 208. The first latching element 206 extends from a first body 234 and the second latching element 208 extends from a second body 236. In some embodiments, the latching elements 206, 208 are integrally formed or part of the respective body 234, 236. However, in other embodiments, the latching elements 206, 208 can be fixedly attached or connected to the respective body 234, 236, without departing from the scope of the present disclosure.

The two bodies 234, 236 are moveable relative to each other along the guide pin 224 which passes through a portion of each of the bodies 234, 236. The guide pin 224 can fixedly install into the housing 204 (e.g., as shown in FIGS. 2A-2C) and thus movably retain the bodies 234, 236 within the cavity 210 of the housing 204. The guide pin 224 can be fixed relative to the housing 204 such that the guide pin 224 does not move within the housing 204.

The two bodies 234, 236 can be operably connected by a link assembly 238. The link assembly 238 includes a first link 240 that is rotatably and/or pivotably connected to the first body 234 and a second link 242 that is rotatably and/or pivotably connected to the second body 236. The first link 240 and the second link 242 are connected or attached by a link connector 244. The link connector 244 is connected to the first and second links 240, 242 such that movement of the link connector 244 causes both of the first and second links 240, 242 to move therewith, such as when the actuation arm 226 presses against the link connector 244.

As the link connector 244 moves, the two links 240, 242 will each move (e.g., pivot, rotate, etc.). As the links 240, 242, the respective bodies 234, 236 move as well. That is, the bodies 234, 236 are urged to move by movement of the respective links 240, 242 in response to movement of the link connector 244. As described herein, as the link connector 244 moves downward (e.g., away from the latching elements 206, 208), the links 240, 242 are moved (e.g., a spreading motion) and the two bodies 234, 236 move away from each other along the guide pin 224. In some configurations, the link connector 244 can be guided between guide structures of the housing and/or of the cover (e.g., housing guide structures 232 and/or cover guide structures 230). For example, a channel may be formed between guide structures to ensure only vertical movement of the link connector 244 and to prevent lateral or sideways movement of the link connector 244.

As shown in FIGS. 2H-2I, the guide pin 224 has first and second biasing members 246, 248. In some embodiments, such as that shown in FIGS. 2A-2I, the biasing members 246, 248 are configured to be located on the guide pin 224 and each positioned between a portion of one of the bodies 234, 236 and a portion of the housing 204. Accordingly, the biasing members 246, 248 are configured to bias the two bodies 234, 236 toward each other. That is, the bodies 234, 236 are movable within the housing 204 along the guide pin 224 and the housing 204 is stationary. Thus, when the link assembly 238 is operated to move the two bodies 234, 236 apart, the bodies 234, 236 act to compress the respective biasing member 246, 248. Although a specific configuration is shown in FIGS. 2A-2I, those of skill in the art will appreciate that alternative configurations are possible without departing from the scope of the present disclosure. For example, in another embodiment, a biasing member can be fixedly connected between the first and second bodies, along the guide pin, and may be configured to pull the two bodies toward each other, and operation of the link assembly will expand the biasing member in such configuration. Further still, in some configurations, the biasing feature may be integrally formed or a characteristic of the link members, the link connector, and/or other part of the link assembly.

Turning now to FIGS. 3A-3F, schematic illustrations of a latch assembly 300 in accordance with an embodiment of the present disclosure are shown. FIGS. 3A-3F illustrate operation or actuation and use of the latch assembly 300. The latch assembly 300 is substantially similar to that shown and described with respect to FIGS. 2A-2I. That is, the latch assembly 300 includes a handle 302, a housing 304, and a latching mechanism 314 (FIG. 3E) is housed within the housing 304 and operable by operation of the handle 302. The latching mechanism 314 includes a first latching element 306 and a second latching element 308 that extend out of the housing 304. The latching elements 306, 308 are configured to operate with a locking bracket 350 that includes a catch arm 352. Although not shown, those of skill in the art will appreciate that the housing 304 and elements contained therein and as part thereof can be fixedly connected to an openable structure and/or closure body (as described above) and the locking bracket 350 can be fixedly connected to a separate structure, such as a frame or wall in which the openable structure opens and closes.

Figure 3A:
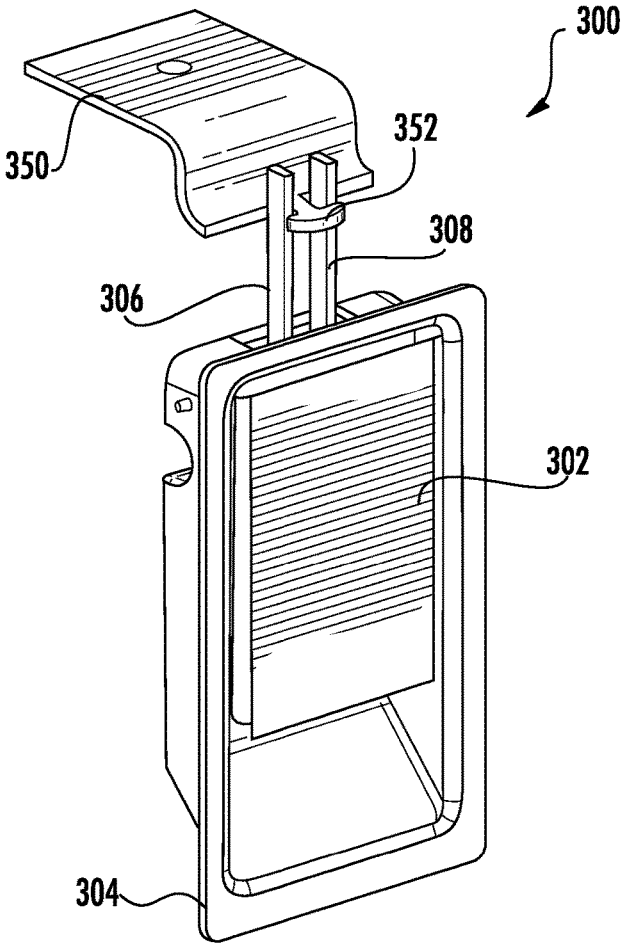
FIG. 3A is a perspective illustration of a latch assembly in accordance with an embodiment of the present disclosure shown in a first state.
Figure 3B:
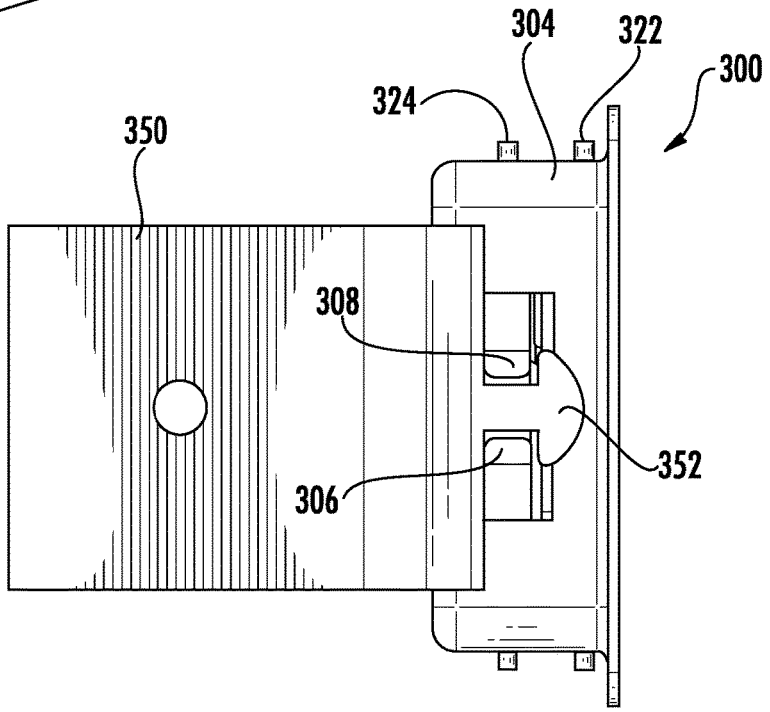
FIG. 3B is a top down plan illustration of the latch assembly of FIG. 3A shown in the first state.
Figure 3C:
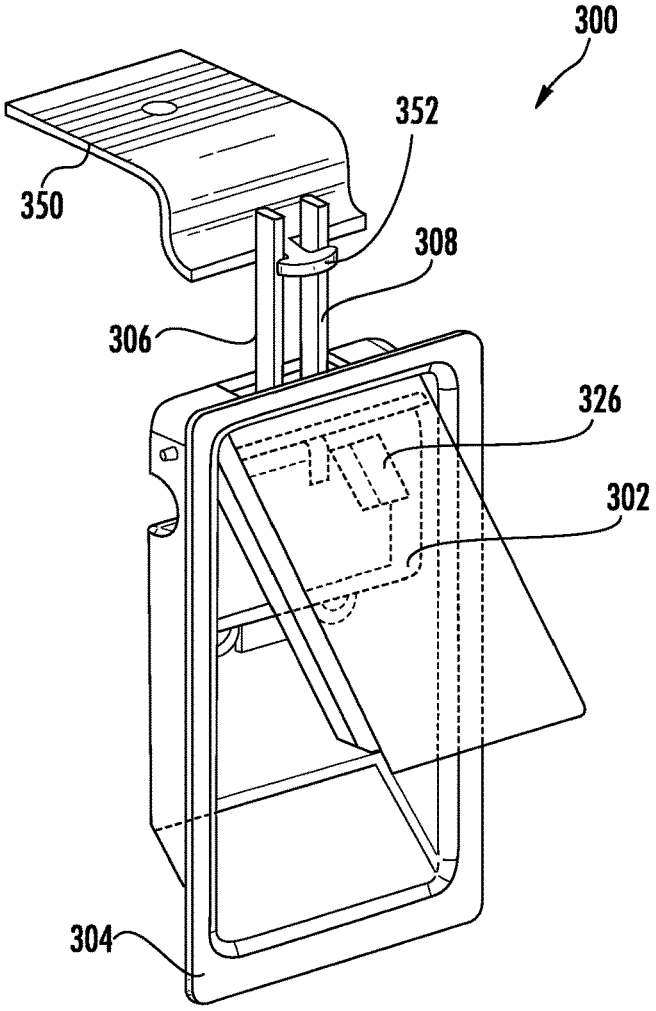
FIG. 3C is a perspective illustration of the latch assembly of FIG. 3A shown in a second state.
Figure 3D:
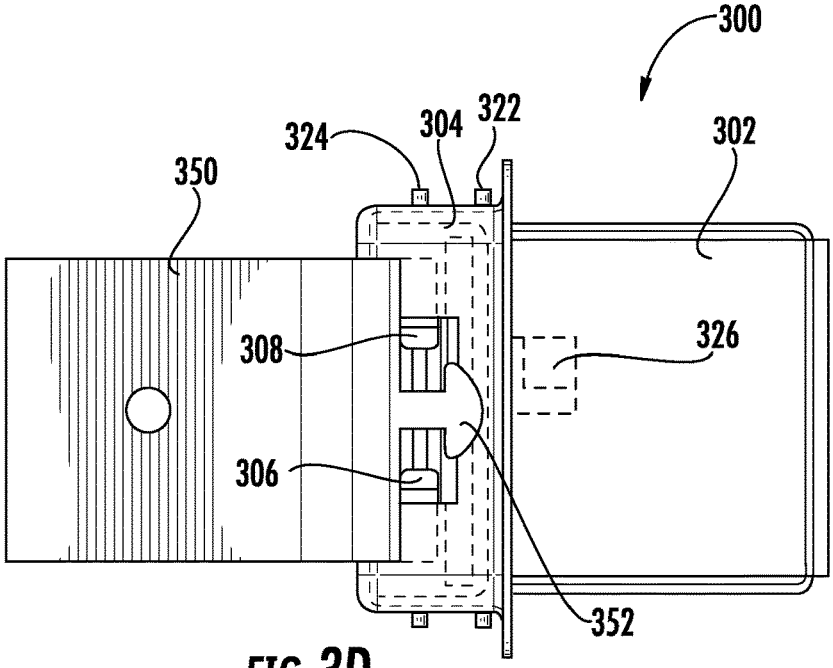
FIG. 3D is a top down plan illustration of the latch assembly of FIG. 3A shown in the second state.
Figure 3E:
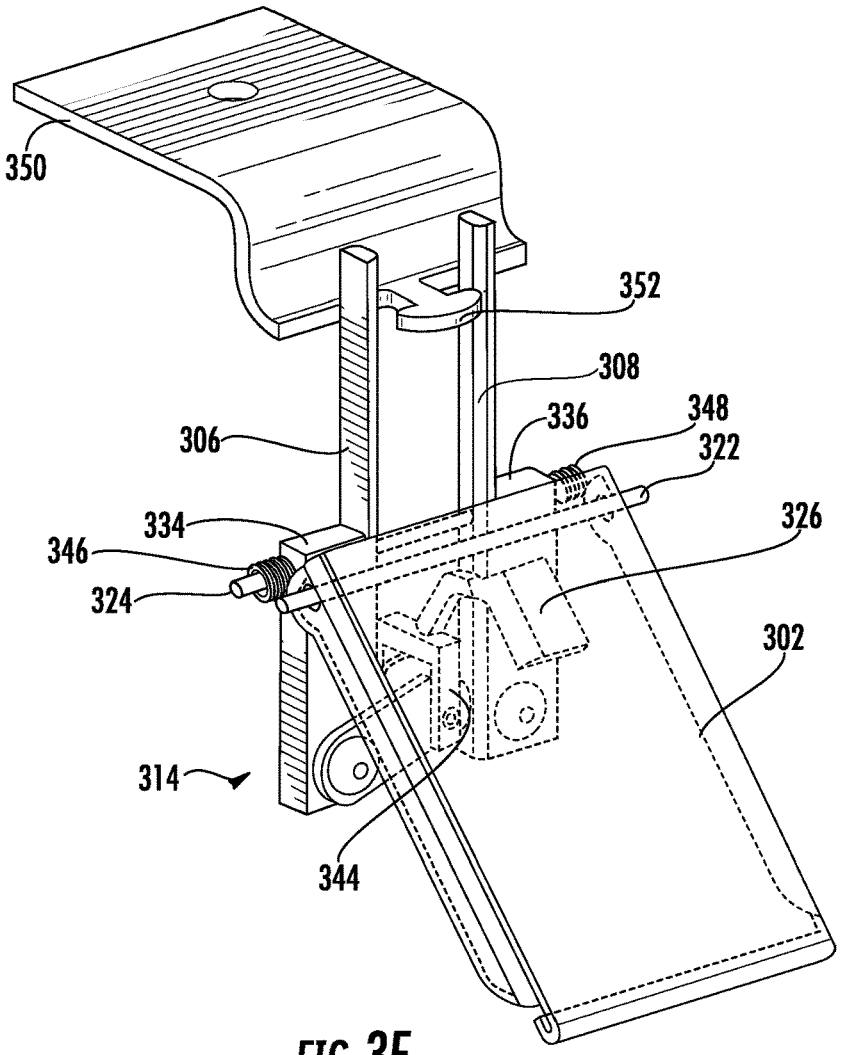
FIG. 3E is a partial transparent illustration of operation of the latch assembly of FIG. 3A.
Figure 3F:
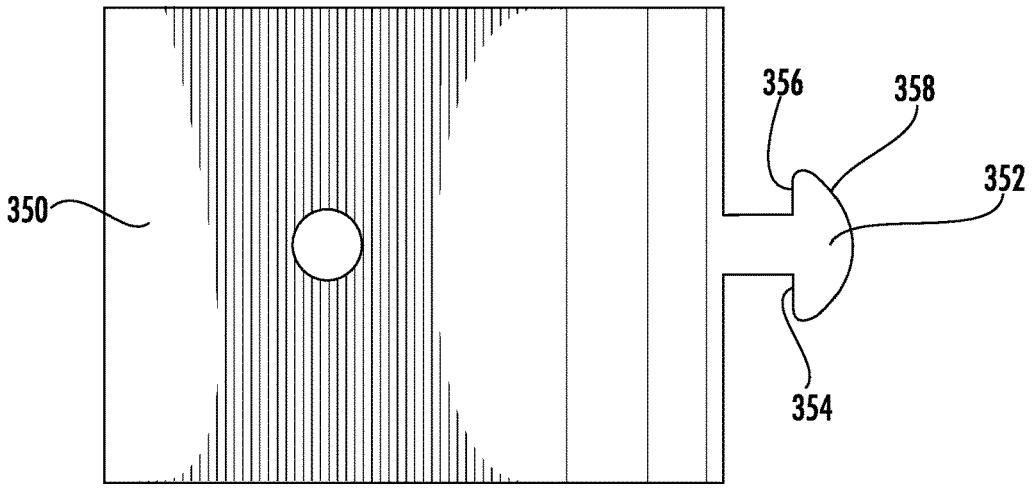
FIG. 3F is a top down plan illustration of a locking bracket that is used in the latching assembly shown in FIG. 3A.

FIG. 3A is a perspective illustration of the latch assembly 300 in a first (e.g., locked or latched) state and FIG. 3B is a top down, plan view illustration of the latch assembly 300 in the first state. FIG. 3C is a perspective illustration of the latch assembly 300 in a second (e.g., unlocked or unlatched) state and FIG. 3D is a top down, plan view illustration of the latch assembly 300 in the second state. FIG. 3E is a perspective illustration of the latch assembly 300 with the housing 304 and a cover removed to illustrate the components of the latching mechanism 314 in the second state. FIG. 3F is a top down, plan view illustration of the locking bracket 350.

With reference to FIG. 3A, the latch assembly 300 includes the complementary locking bracket 350 (e.g., part or integral with frame 101*b*) which includes the catch arm 352 that extends from the locking bracket 350. In the first state (FIGS. 3A-3B), the latching elements 306, 308 are engaged with the catch arm 352 of the locking bracket 350 to thus prevent movement of the housing 304 relative to the locking bracket 350. For example, with reference to FIG. 3F, the catch arm 352 includes a first stop surface 354 and a second stop surface 356 that are configured to stop or catch respective latching elements 306, 308 from in a direction away from the locking bracket 350. Also shown in FIGS. 3A-3B, the handle 302 is flush or within the housing 304.

As shown in FIG. 3B, the first and second latching elements 306, 308 are positioned behind the respective first and second stop surfaces 354, 356. As such, when in the first state, the latching elements 306, 308 are prevented from movement in a direction away from the locking bracket 350 (e.g., to the right in the illustration). Also, as noted above, the latching elements 306, 308 are attached to the bodies of the latching mechanism 314 which can be biased toward each other, and thus the latching elements 306, 308 will not move away from the catch arm 352 (e.g., up and down in the illustration). As such, the latching elements 306, 308 will securely hold and retain a closure body relative to the locking bracket 350.

With reference now to FIGS. 3C-3E, the latch assembly 300 is shown in the second (e.g., unlocked or unlatched) state. As shown, the handle 302 is pulled out from or raised away from the housing 304 about a handle pin 322. As the handle 302 rotates about the handle pin 322, an actuation arm 326 is moved to contact and/or apply force to a link connector 344 of the latching mechanism 314 (e.g., as described above). The link connector 344 operates on links of the latching mechanism 314 to thus urge two bodies apart (as described above). The bodies move apart along a guide pin 324. As the two bodies move apart the first and second latching elements 306, 308 move away from each other. The separation between the first and second latching elements 306, 308 can be increased to a separation distance that is greater than a width dimension of the catch arm 352 such that the first and second latching elements 306, 308 can move freely past the catch arm 352 and enabling movement (e.g., opening) of a openable structure in which the latch assembly 300 is installed or connected.

When it is desired to move the openable structure (e.g., closure body such as a panel or door) back into a locked or secured position, the openable structure can be closed. As the openable structure closes, the latching elements 306, 308 will contact the catch arm 352. The catch arm 352 includes a spreading surface 358 that is curved, contoured, or otherwise shaped such that as the latching elements 306, 308 contact the spreading surface 358 the two latching elements 306, 308 spread apart or separate a sufficient distance such that the latching elements 306, 308 can move toward the locking bracket 350 and move into position to contact the stop surfaces 354, 356. It will be appreciated that as the latching elements 306, 308 move along the spreading surface 358 the bodies that are attached to the latching elements 306, 308 will move along the guide pin 324 and biasing members 346, 348 will be compressed. Once the latching elements 306, 308 move past the width dimension of the catch arm 352, the biasing members 346, 348 will urge the latching elements 306, 308 into contact with the stop surfaces 354, 356 (e.g., as shown in FIGS. 3A-3B).

Figure 4A:
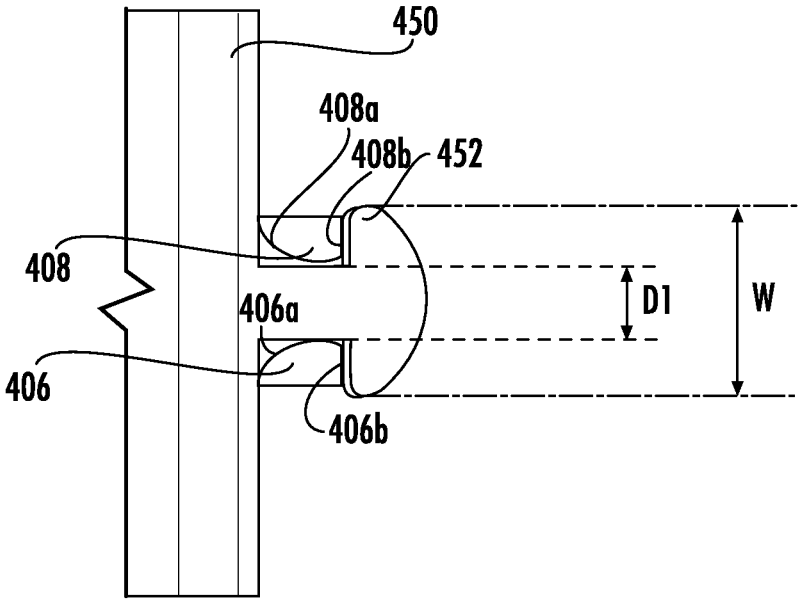
FIG. 4A is a schematic illustration showing orientation of components of a latch assembly in accordance with an embodiment of the present disclosure, shown in a first state.
Figure 4B:
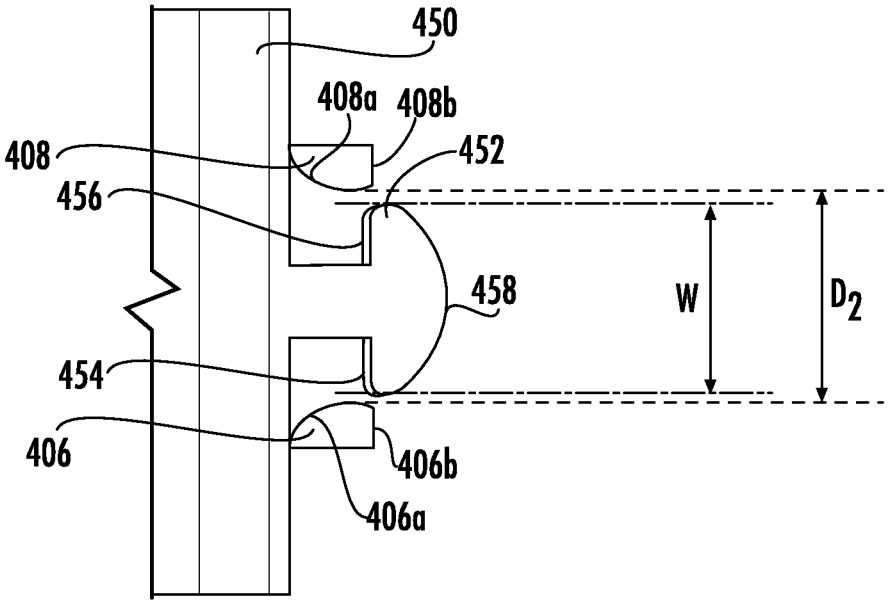
FIG. 4B is a schematic illustration showing a second state orientation of the components shown in FIG. 4A.

Turning now to FIGS. 4A-4B, schematic illustrations of the interaction of latching elements 406, 408 with respect to a locking bracket 450 are shown. FIG. 4A is an illustration of the latching elements 406, 408 in the first state (e.g., locked, latched, secured, etc.) and FIG. 4B is an illustration of the latching elements 406, 408 spread such that the latching elements 406, 408 can move past a catch arm 452. As shown, the catch arm 452 has a width W. In the first state, the latching elements 406, 408 are separated by a first separation distance $D_1$ that is less than the width W of the catch arm 452, as shown in FIG. 4A. As a handle of a latch assembly that includes the latching elements 406, 408 is actuated, the latching elements 406, 408 are forced to spread apart to a second separation distance $D_2$. The second separation distance $D_2$ is greater than the width W of the catch arm 452, and thus the latching elements 406, 408 can freely move past the catch arm 452 to open an openable structure that the latching elements 406, 408 and locking bracket 450 are part of.

As shown, the catch arm 452 includes a spreading surface 458 and stop surfaces 454, 456. Further, as shown, the latching elements 406, 408 can include respective, complementary engagement surfaces 406*a*, 408*a*. The complementary engagement surfaces 406*a*, 408*a* are contours or curved surfaces of the respective latching elements 406, 408 that enable ease of spreading of the latching elements 406, 408 when moving from an open position of the closure body to a closed position of the closure body (e.g., as the latching elements 406, 408 move along the spreading surface 458). Additionally, the latching elements 406, 408 can include complementary stop surfaces 406*b*, 408*b* that can engage with the stop surfaces 454, 456 of the catch arm 452 to provide secure engagement and locking of a closure body in a closed state.

The above description applied to a single latch assembly installed within a closure body of an openable structure. However, in some configurations, two or more latch assemblies may be desired. For example, two or more latch assemblies can provide additional securing of an openable structure, the openable structure may be sufficiently large to require more than a single latch assembly to securely retain the openable structure in a closed state.

Figure 5B:
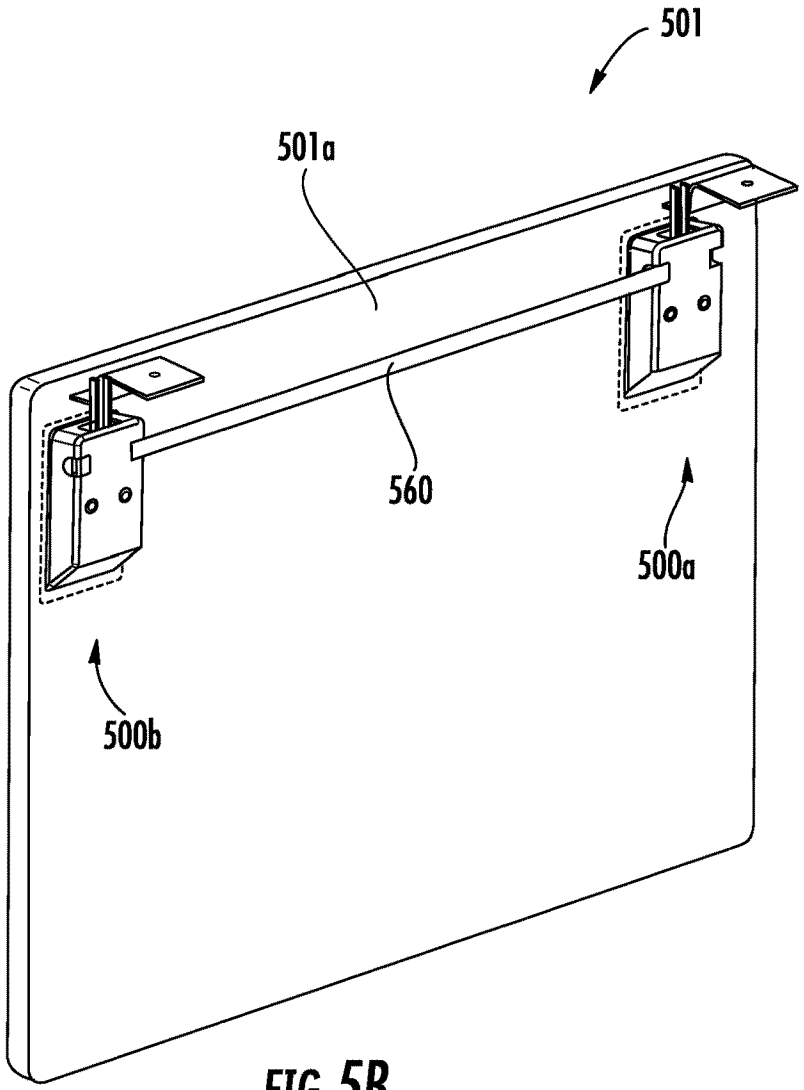
FIG. 5B is a rear perspective illustration of the openable structure shown in FIG. 5A.
Figure 5A:
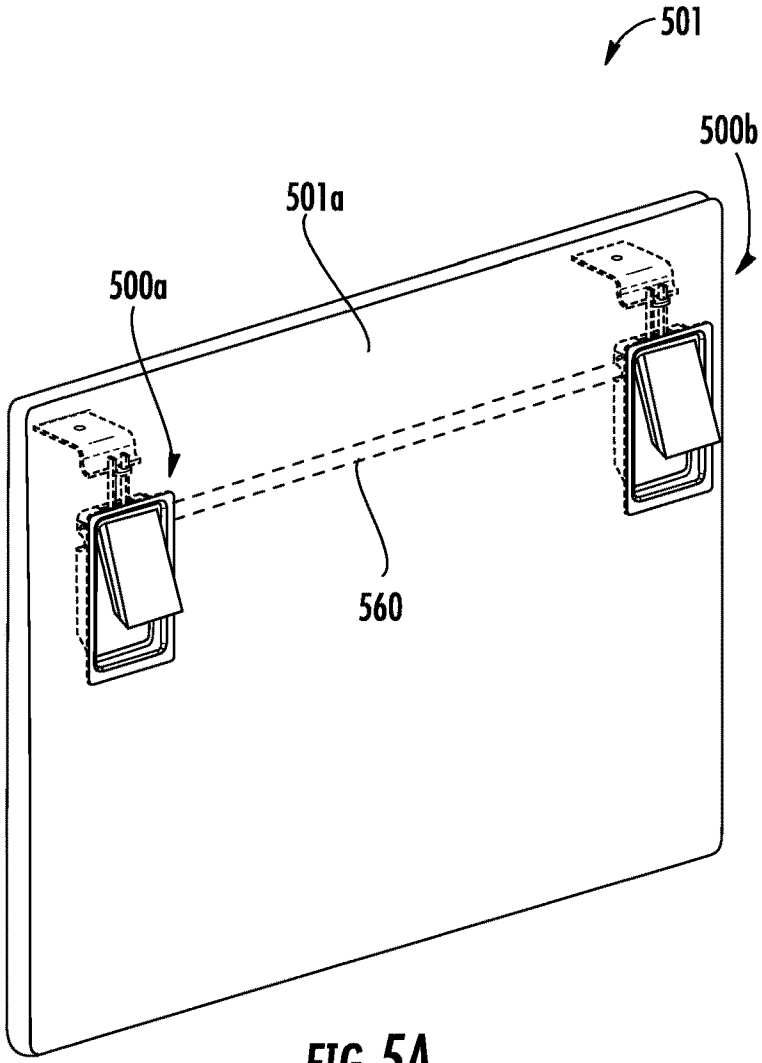
FIG. 5A is a front perspective illustration of an openable structure having multiple connected latch assemblies in accordance with an embodiment of the present disclosure.

For example, turning now to FIGS. 5A-5D, an openable structure 501 having a closure body 501*a* and multiple latch assemblies 500*a*, 500*b* in accordance with an embodiment of the present disclosure is shown. FIG. 5A is a front perspective illustration of the closure body 501*a* transparently shown to illustrate an assembly connector 560 between a first latch assembly 500*a* and a second latch assembly 500*b*. The latch assemblies 500*a*, 500*b* are substantially similar to the latch assemblies shown and described above, and thus similar features and structures will not be described again. Each of the latch assemblies 500*a*, 500*b* includes a handle, a housing, and a latching mechanism within the housing. As described above, the latching mechanisms of the latch assemblies 500*a*, 500*b* may be operated by increasing a distance between two bodies along a guide pin such that latching elements are spread apart to operate about a catch. FIG. 5B is a rear perspective illustration of the openable structure 501. The latch assemblies 500*a*, 500*b* are connected by the assembly connector 560 to operate synchronously or in tandem when one of the two latch assemblies 500*a*, 500*b* is operated. That is, operation of the first latch assembly 500*a* will cause operation of the second latch assembly 500*b* such that the closure body 501*a* can be opened (and vice versa).

Figure 5C:
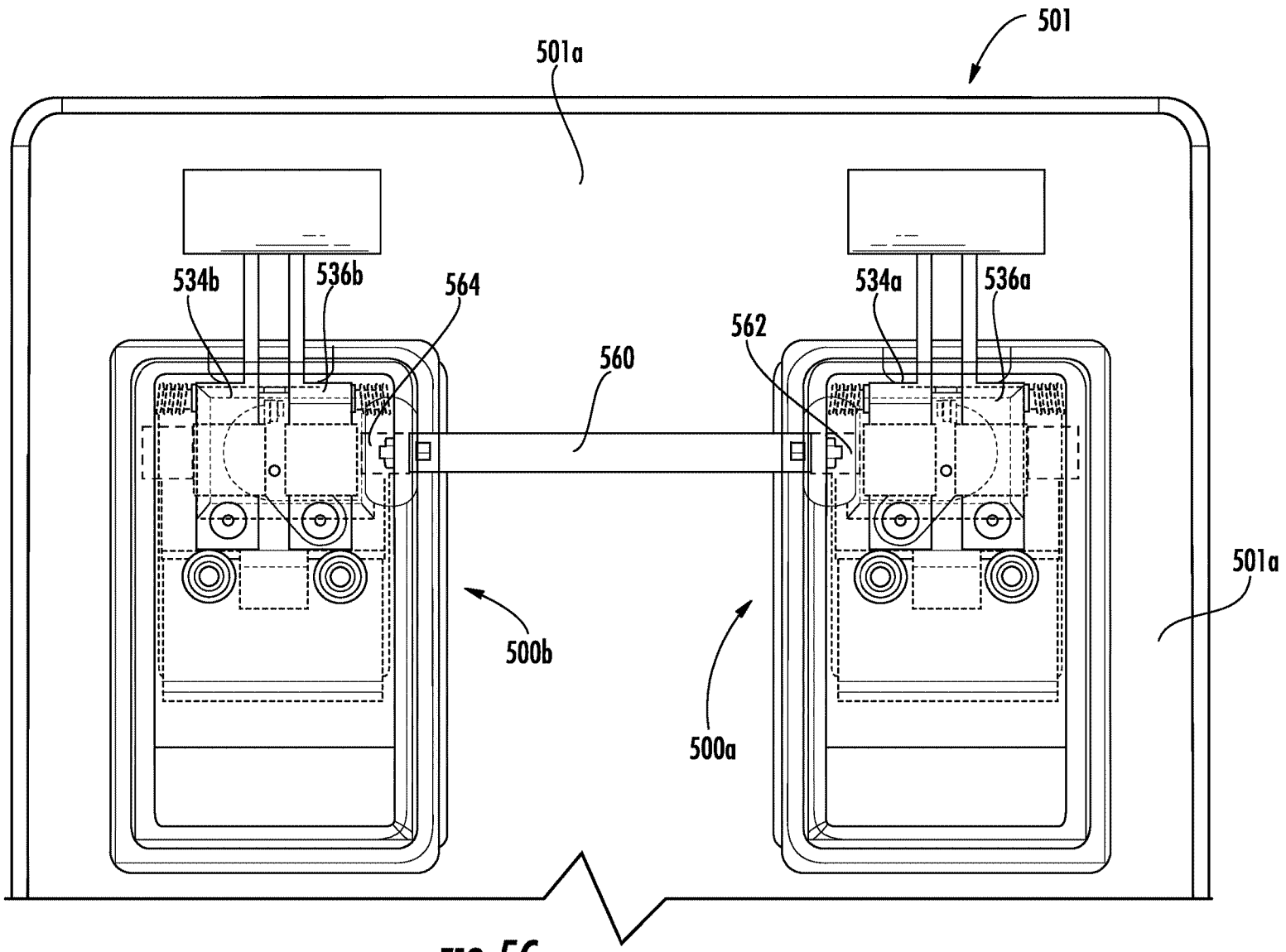
FIG. 5C is a schematic enlarged illustration of the multiple latch assemblies shown in FIG. 5A.

FIG. 5C is a schematic illustration showing the assembly connector 560 and the latch assemblies 500*a*, 500*b* in more detail. As shown and described above, the first latch assembly 500*a* includes a first body 534*a* and a second body 536*a*, with each body having a respective latching element extending therefrom. Similarly, the second latch assembly 500*b* includes a first body 534*b* and a second body 536*b*, with each both having a respective latching element extending therefrom. It is noted that the first body 534*a*, 534*b* of each latch assembly 500*a*, 500*b* is located in the same position within the respective latch assembly 500*a*, 500*b*. That is, each first body 534*a*, 534*b* is located to the left within the respective latch assembly 500*a*, 500*b* in the illustration and, similarly, each second body 536*a*, 536*b* is located to the right with the respective latch assembly 500*a*, 500*b* in the illustration. Accordingly, each first body 534*a*, 534*b* moves in the same direction when actuating (e.g., to the left) and each second body 536*a*, 536*b* moves in the same direction when actuation (e.g., to the right).

The assembly connector 560 operably connects the first latch assembly 500*a* to the second latch assembly 500*b* such that the two latch assemblies can operate synchronously, even if only one of the two latch assemblies 500*a*, 500*b* is operated. The assembly connector 560 enables movement of one body of one latch assembly to urge movement of the same body in the other latch assembly. For example, in the embodiment shown in FIGS. 5A-5D, the first body 534*a* of the first latch assembly 500*a* is operably connected to the first body 534*b* of the second latch assembly 500*b*. Thus, when a handle of the first latch assembly 500*a* is operated and the first and second bodies 534*a*, 536*a* of the first latch assembly 500*a* move apart (as described above), the assembly connector 560 enables the first body 534*a* to urge the first body 534*b* of the second latch assembly 500*b* to move in tandem. The movement of the first body 534*b* of the second latch assembly 500*b* forces a link assembly (as described above) of the second latch assembly 500*b* to operate, thus moving the second body 536*b* of the second latch assembly 500*b* to thus enable separation of the respective latching elements, and further enabling opening of the closure body 501*a*.

A first coupling 562 connects the first body 534*a* of the first latch assembly 500*a* to the assembly connector 560. The first coupling 562 can be fixedly and/or rigidly connected or attached to the first body 534*a* of the first latch assembly 500*a*. In some embodiments, the first coupling 562 can be integrally formed with or part of the first body 534*a* of the first latch assembly 500*a*. The connection between the first coupling 562 and the assembly connector 560 can be by fastener or other attachment means or, in some embodiments, the first coupling 562 can be integrally formed with the assembly connector 560.

Figure 5D:
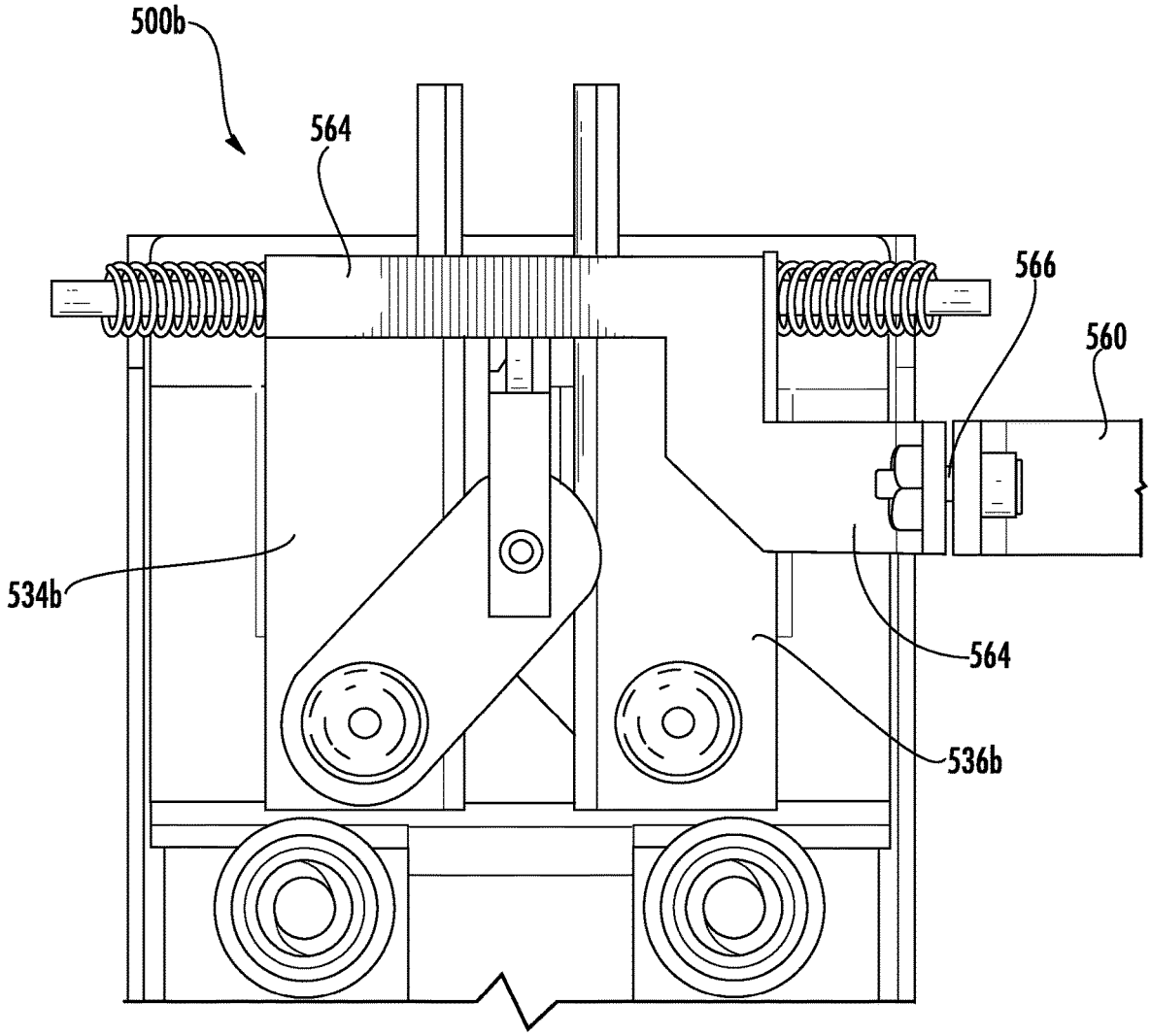
FIG. 5D is an enlarged, detailed schematic illustration of one of the multiple latch assemblies shown in FIG. 5A.

Similarly, a second coupling 564 connects the first body 534*b* of the second latch assembly 500*b* to the assembly connector 560 (see also, FIG. 5D). The second coupling 564 can be fixedly and/or rigidly connected or attached to the first body 534*b* of the second latch assembly 500*b*. In some embodiments, the second coupling 564 can be integrally formed with or part of the first body 534*b* of the second latch assembly 500*b*. The connection between the second coupling 564 and the assembly connector 560 can be by fastener or other attachment means or, in some embodiments, the second coupling 564 can be integrally formed with the assembly connector 560. For example, as shown in FIG. 5D, a fastener 566 is shown connecting the second coupling 564 with the assembly connector 560.

The assembly connector 560, the couplings 562, 564, and the associate fasteners 566 can be shaped and sized to pass through connection apertures formed in the housing of the respective latch assemblies (see, for example, connection apertures 218 shown in FIG. 2G).

Although shown in FIGS. 5A-5D with a single assembly connector 560 connecting the first bodies 534*a*, 534*b* of the two latch assemblies 500*a*, 500*b*, additional assembly connectors can be employed. For example, in some configurations, two assembly connectors can be used with a first assembly connector connecting the first bodies of two latch assemblies and a second assembly connector connecting the second bodies of the same two latch assemblies. Moreover, additional connections can be used to synchronously operate more than two latch assemblies. That is, the present disclosure is not limited to a dual latch system, but rather multiple latch assemblies can be connected such that operation of a single latch assembly of the system will operate all latch assemblies of the system.

In some embodiments, the handles of all latch assemblies in a multi latch assembly system can move or operate with the operation of just one of the handles. That is, in some embodiments, a handle biasing mechanism, such as a torsion spring, can be installed on the handle pin of each latch assembly. One end of the handle biasing mechanism can rest or contact the handle (e.g., handle 202) and another end of the handle biasing mechanism can rest or contact a portion of the housing (e.g., housing 204) and/or the cover (e.g., cover 212). In such a configuration, the handle biasing mechanism may be configured to always urge the handle toward an open position. However, the biasing members (e.g., biasing members 246, 248) of the latching mechanism of the latch assembly can be stiffer or have a higher spring constant than the handle biasing mechanism. Accordingly, the biasing members urge the bodies of the latching mechanism toward each other, and thus the link connector is moved upward and urges the actuation arm of the handle to close the handle. Then, when one of the bodies is urged away from the other body, the link connector will move downward and the handle will open.

Figure 6:
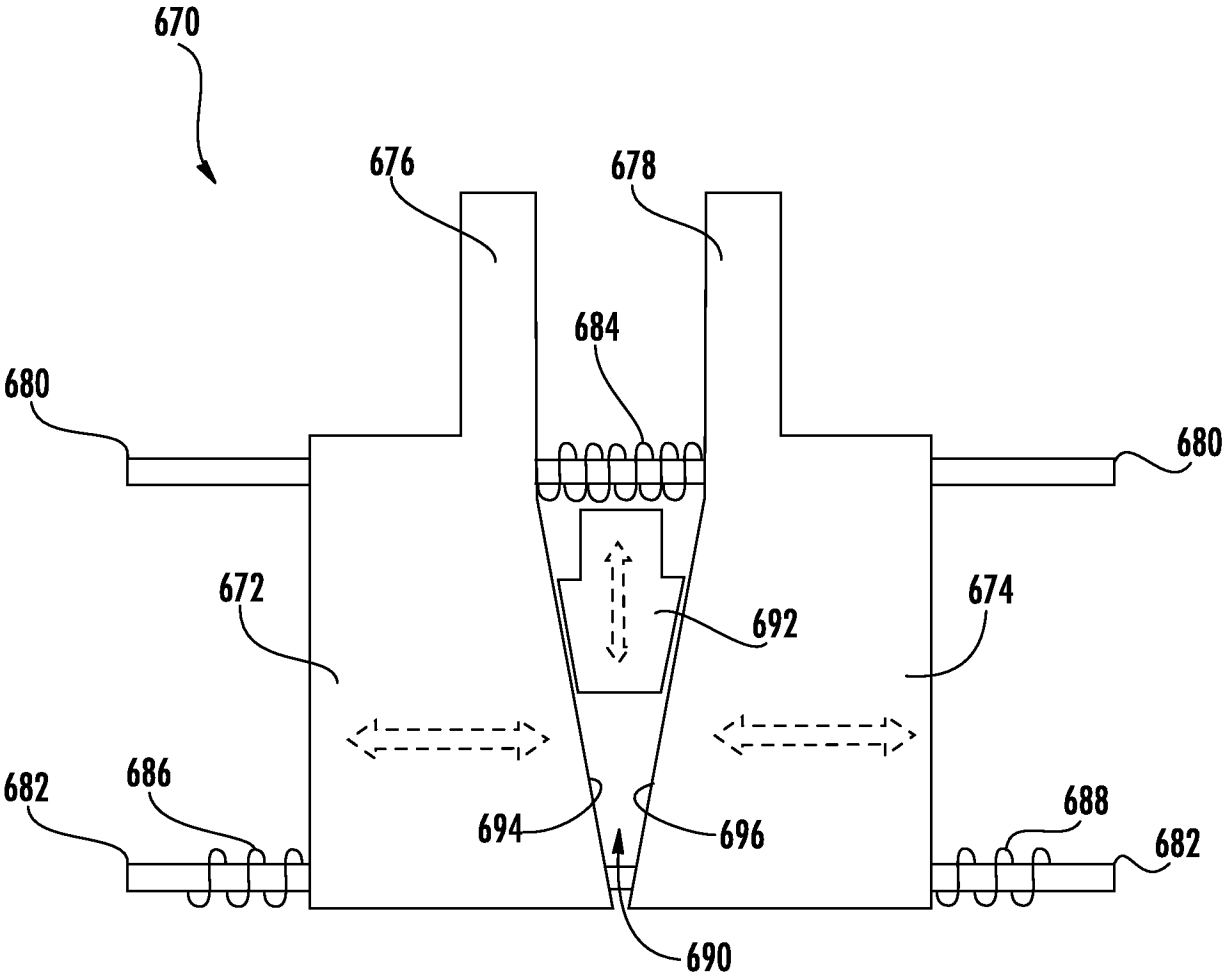
FIG. 6 is a schematic illustration of an alternative configuration of a latching mechanism in accordance with a non-limiting embodiment of the present disclosure.

Turning now to FIG. 6, a schematic illustration of an alternative embodiment of a latch assembly in accordance with the present disclosure is shown. As shown in FIG. 6, a latching mechanism 670 includes a first body 672 and a second body 674, as described above. The latching mechanism 670 may be substantially similar to that described above and thus similar features and structures may be omitted for clarity and brevity. The first and second bodies 672, 674 each have respective latching elements 676, 678 extending therefrom, as described above. The first and second bodies 672, 674 are movably mounted on guide pins 680, 682. As shown, two guide pins 680, 682 are configured to aid in guiding the movement of the bodies 672, 674 relative to each other. The guide pins 680, 682 can be mounted to a housing (not shown) as described above.

The bodies 672, 674 can be biased within the housing by one or more biasing members. As shown, the first guide pin 680 has a single biasing member 684 positioned between the first and second bodies 672, 674. The biasing member 684 can be configured to pull the two bodies 672, 674 toward each other. Further, as shown, the second guide pin 682 has two biasing members 686, 688 positioned to the exterior of the bodies 672, 674 and would engage between the respective bodies 672, 674 and a portion or surface of the housing that houses the latching mechanism 670. In some embodiments, such as shown in FIG. 6, the biasing member 684 is an extension spring and the biasing members 686, 688 are compression springs. However, those of skill in the art will appreciate that other types of biasing members can be used without departing from the scope of the specification. For example, the guide pins 680, 682 may integrally include a biasing feature.

The latching mechanism 670 shown in FIG. 6 operates differently than that shown and described above. In this non-limiting configuration, rather than including a link assembly, the bodies 672, 674 are urged by a wedge assembly 690. The wedge assembly 690 includes a movable wedge 692 that moves along inclined surfaces 694, 696 of the bodies 672, 674. The movable wedge 692 is actuated and moved similar to the link assembly described above. That is, an actuation arm that is attached to a handle can be moved or tilted to urge the movable wedge 692 downward, which will urge the two bodies 672, 674 apart, thus separating the latching elements 676, 678 to enable disengagement from a catch arm (as indicated by the dashed arrows in FIG. 6).

Advantageously, various embodiments of the latch assemblies described herein are designed to overcome reliability issues associated with prior latch assembly configurations. Such improvement is achieved by means of improved and new mechanisms for locking and unlocking actions of the active latching elements of the latch assemblies. The latch assemblies described herein include latching elements, a latching mechanism to move the latching elements apart included for unlocking. Further, biasing mechanisms, such as spring, are provided for biasing and retracting the latching elements for locking and securing the latching elements with a catch or locking bracket. Guide pin(s) act as guides for transverse latching element movement, that is, the guide pin(s) provide a guide upon which bodies that support the latching elements move in a lateral or transverse direction. Operating a handle moves an actuation arm which may push on a link connector that thus urges opposing links to move in opposite directions and thus separate the latching elements for unlocking. This action moves the bodies and latching elements apart along the guides and generates a sufficient gap or separation so as to disengage the latch from holding or locking bracket (e.g. a catch) and thus opening the closure (e.g., a door) to which the latch assembly is part of or attached to. For locking the closure, the closure is pushed against the locking bracket. The profile on the front face of the catch will split or move the latching elements apart and the biasing mechanisms in the latch assembly will retract and the profile on the backside of the catch with which the latching elements are engaged will keep the closure in a locked position.

Further, advantageously, various embodiments provided herein are direct to a synchronous multiple latch assembly. The multiple latch assembly system achieves synchronous movement of left and right latch assemblies under any condition which is the design intent and also can provide a cost benefit by avoidance of frequent replacement of system. In accordance with some embodiments, the multiple latch system includes two latch assemblies (e.g., left and right) that are interconnected by means of an assembly connector. The left and right hand latch assemblies are formed similar to that described above. On operating one of the latch assemblies, the latching elements will move apart and create a sufficient gap so as to disengage the latching elements from the locking bracket and thus enable opening of the closure to which the multiple latch assemblies are attached. As described herein, synchronous movement of both latches. The synchronous movement is provided with the connected latch assemblies. The assembly connector connects one of the latching element bodies in each latch assembly such that tandem or synchronous operation is achieved. That is, in some configurations, when a left hand handle of a left side latch assembly is moved rotationally upward, the left hand latching elements move apart which in turn moves the assembly connector. Such movement of the assembly connector will move the right hand latching element apart. Thus synchronous opening or closing of both latch assemblies can be achieved.

Advantageously, the latching mechanism and biased elements can provide a more reliable and consistent operation for locking/unlocking action. Such improved reliability and consistency can improve latch assembly life. Further, advantageously, in the systems having multiple connected latch assemblies, only lateral or transilatory movement is required within the system to achieve locking/unlocking. Prior systems have transilatory motion that is converted to a rotary motion that is then, in turn, converted back to transilatory motion. Such changes in motion can lead to motion loss, slippage, stoppage, failure, etc. In contrast, embodiments of the present disclosure enable the use of only transilatory or lateral movement and thus no motion loss is experienced.

The use of the terms "a", "an", "the", and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A latch assembly for opening and closing an openable structure, the latch assembly comprising:

a housing defining a cavity;

a handle movably mounted to the housing; and a latching mechanism in the cavity and disposed between the handle and the housing, the latching mechanism comprising:

at least one guide pin mounted to the housing;

a first body movable along the at least one guide pin, the first body having a first latching element extending through the housing;

a second body movable along the at least one guide pin, the second body having a second latching element extending through the housing;

a first link attached to the first body;

a second link attached to the second body; and a link connector operably connecting the first link to the second link, wherein movement of the link connector urges the first latching element and the second latching element apart through movement of the first link and the second link and the first body and the second body.

2. The latch assembly of claim 1, further comprising an actuation arm fixedly connected to the handle such that movement of the handle causes movement of the link connector.

3. The latch assembly of claim 2, further comprising a cover installed between the handle and the latching mechanism within the cavity, the cover configured to cover the first body and the second body.

4. The latch assembly of claim 3, wherein the cover includes at least one cover guiding structure, the cover guiding structure configured to guide movement of the link connector.

5. The latch assembly of claim 3, wherein the cover includes an actuation slot where the actuation arm passes through the cover to interact with the link connector.

6. The latch assembly of claim 2, wherein the housing includes at least one housing guiding structure, the housing guiding structure configured to guide movement of the link connector.

7. The latch assembly of claim 1, further comprising at least one biasing member disposed on the at least one guide pin and configured to urge the first body toward the second body along the at least one guide pin.

8. The latch assembly of claim 7, wherein the at least one biasing member comprises a first biasing member disposed between the first body and the housing and a second biasing member disposed between the second body and the housing.

9. The latch assembly of claim 1, further comprising a locking bracket configured to receive the first latching member and the second latching member to secure the latching members in a first state.

10. The latch assembly of claim 9, wherein the locking bracket includes a catch arm, the catch arm having at least one stop surface configured to receive the first latching element and the second latching element to secure the first and second latching elements in the first state.

11. The latch assembly of claim 10, the catch arm further comprising a spreading surface configured to spread the first latching member apart from the second latching member when the latch assembly is moved into the first state.

12. The latch assembly of claim 11, wherein each of the first latching element and the second latching element comprise a complementary engagement surface that engages with and runs along the spreading surface of the catch arm.

13. The latch assembly of claim 10, wherein a portion of the catch arm has a width and the first and second latching elements are separated by a first separation distance that is less than the width of the catch and the first and second latching elements are separated by a second separation distance that is greater than the width of the catch such that the first and second latching elements can move freely relative to the catch arm.

14. A latch assembly for opening and closing an openable structure, the latch assembly comprising:

a housing defining a cavity;

a handle movably mounted to the housing; and a latching mechanism in the cavity and disposed between the handle and the housing, the latching mechanism comprising:

at least one guide pin mounted to the housing;

a first body movable along the at least one guide pin, the first body having a first latching element extending through the housing and having an inclined surface;

a second body movable along the at least one guide pin, the second body having a second latching element extending through the housing and having an inclined surface;

a movable wedge positioned between the inclined surfaces of the first body and the second body; and an actuation arm fixedly connected to the handle such that movement of the handle causes movement of the movable wedge, wherein movement of the movable wedge urges the first latching element and the second latching element apart through movement of the first body and the second body spread by the movable wedge along the inclined surfaces.

15. An openable structure comprising:

a frame;

a closure body movable relative to the frame; and a first latch assembly at least partially installed to the closure body, the first latch assembly comprising:

a housing defining a cavity, the housing fixedly attached to the closure body;

a handle movably mounted to the housing; and a latching mechanism in the cavity and disposed between the handle and the housing, the latching mechanism comprising:

at least one guide pin mounted to the housing;

a first body movable along the at least one guide pin, the first body having a first latching element extending through the housing;

a second body movable along the at least one guide pin, the second body having a second latching element extending through the housing;

a first link attached to the first body;

a second link attached to the second body; and a link connector operably connecting the first link to the second link, wherein movement of the link connector urges the first latching element and the second latching element apart through movement of the first link and the second link and the first body and the second body.

16. The openable structure of claim 15, further comprising a locking bracket mounted to the frame and configured to receive the first latching member and the second latching member to secure the latching members in a first state such that the closure body is secured within the frame.

17. The openable structure of claim 16, wherein the locking bracket includes a catch arm, the catch arm having at least one stop surface configured to receive the first latching element and the second latching element to secure the first and second latching elements in the first state.

18. The openable structure of claim 17, the catch arm further comprising a spreading surface configured to spread the first latching member apart from the second latching member when the latch assembly is moved into the first state.

19. The openable structure of claim 17, wherein a portion of the catch arm has a width and the first and second latching elements are separated by a first separation distance that is less than the width of the catch and the first and second latching elements are separated by a second separation distance that is greater than the width of the catch such that the first and second latching elements can move freely relative to the catch arm.

20. The openable structure of claim 15, further comprising a second latch assembly, wherein the first and second latch assemblies are operably connected to operate synchronously upon operating of one of the first or second latch assemblies.

* * * * *